US005489050A

United States Patent [19]

Finkiewicz et al.

[11] Patent Number: 5,489,050

[45] Date of Patent: Feb. 6, 1996

[54] INSERT FOR A BOTTLE CLOSURE

[75] Inventors: Daniel J. Finkiewicz, Schaumburg; Gerald R. Sorensen, Elgin; John E. Sowinski, Park Ridge, all of Ill.

[73] Assignee: NCM International, Inc., Arlington Heights, Ill.

[21] Appl. No.: 230,046

[22] Filed: Apr. 19, 1994

[51] Int. Cl.[6] ..... B67D 3/00

[52] U.S. Cl. ..... 222/525; 222/78; 222/559

[58] Field of Search ..... 222/78, 212, 522, 222/523, 525, 531, 559

[56] References Cited

U.S. PATENT DOCUMENTS

| | | | |
|---|---|---|---|
| 2,543,850 | 6/1951 | Henricson | 222/78 X |
| 2,969,168 | 1/1961 | Newby | 222/525 |
| 3,511,420 | 5/1970 | Kessler | 222/525 |
| 3,981,421 | 9/1976 | McDowell, Jr. et al. | 222/521 |
| 4,408,700 | 10/1983 | Fillmore et al. | 222/522 X |
| 4,979,648 | 12/1990 | Montgomery et al. | 222/522 X |

*Primary Examiner*—Andres Kashnikow

*Assistant Examiner*—Joseph A. Kaufman

*Attorney, Agent, or Firm*—Wallenstein & Wagner, Ltd.

[57] ABSTRACT

A three piece closure for selectively controlling flow of product from a container, and method of manufacture, are disclosed. The closure includes an inner member, an outer member and an insert disposed therebetween. The inner member is adapted for attachment to a necked opening of the container. The outer member has a base portion, a top portion, and an inward flange disposed substantially circumferentially about the base of the outer member. The insert has a base portion and a radially outward flange disposed substantially circumferentially about the base portion. Upon insertion of the insert into the outer member, the outward flange passes the inward flange to provide cooperative engagement with the inward flange such that axial movement of the outer member causes axial movement of the insert to control the flow of the product. The inward flange of the outer member includes a taper portion tapering radially inward away from the base portion, such that insertion of the insert into the outer member causes the taper portion of the insert to progressively outwardly expand the inward flange of the outer member to assist assembly thereof.

5 Claims, 1 Drawing Sheet

INSERT FOR A BOTTLE CLOSURE

TECHNICAL FIELD

The present invention relates to closures for bottles, and more particularly to an improved insert for a closure which simplifies assembly thereof.

BACKGROUND PRIOR ART

Three piece decorative closures for selectively controlling flow of product from a container are well known in the art. One such closure includes an inner member, a decorative outer member and an insert disposed therebetween.

The inner member typically has a threaded portion adapted for attachment to a similarly threaded neck of the container. The decorative outer member has a base portion, a top portion, and an inward flange disposed substantially circumferentially about the base of the outer member. The insert has a base portion and a radially outward flange disposed substantially circumferentially about the insert base portion. Upon insertion of the insert into the outer member, the outward flange of the insert passes the inward flange of the outer member to provide cooperative engagement therebetween with the inward flange such that axial movement of the outer member causes axial movement of the insert to control the flow of the product from the container. Because the prior art outward flange is in the configuration of a circumferential bead, or generally semi-circular in cross-section, assembly of the closure is difficult, as it has been difficult to force the outward flange past the inward flange.

The present invention is provided to solve this and other problems.

SUMMARY OF THE INVENTION

It is an object of the invention to provide a closure and method of assembly thereof.

In accordance with the invention, the outward flange of the insert includes a taper portion tapering radially inward away from the base portion, such that insertion of the insert into the outer member causes the taper portion of the insert to progressively outwardly expand the inward flange of the outer member to assist assembly thereof.

Other features and advantages of the invention will be apparent from the following specification taken in conjunction with the following drawings.

DETAILED DESCRIPTION

Figure 1:
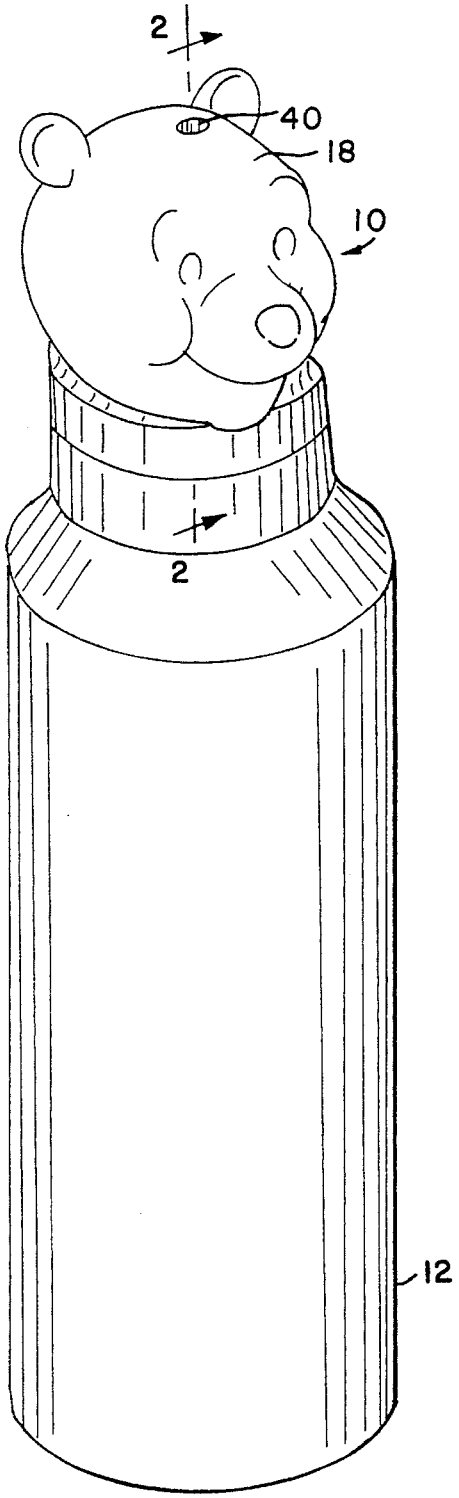
FIG. 1 is a perspective view of a container having a closure according to the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 2:
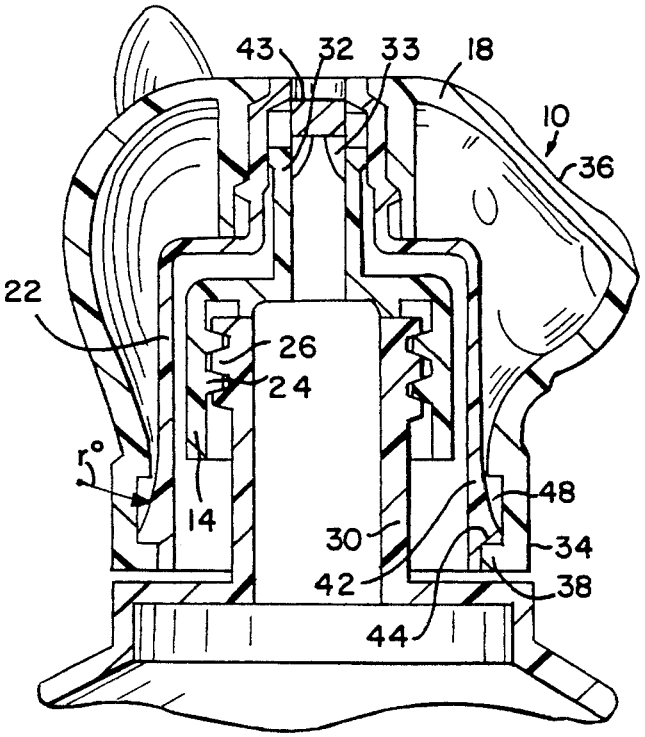
FIG. 2 is a sectional view of the closure of FIG. 1, taken along lines 2—2 thereof.

A closure 10 for selectively controlling flow of product from a container 12 is illustrated in FIGS. 1 and 2.

The closure 10 comprises an inner member 14, an outer member 18 and an insert 22. The inner member 14 is formed of polyethylene, and includes radially inward threads 24 adapted for attachment to complementary container threads 26 helically disposed about a neck 30 of the container 12. The inner member 14 further includes an inner spout portion 32, having three radial openings 33 discussed below.

The outer member 18 is formed of pvc, and has a base portion 34, a top portion 36 and a radially inward flange 38 disposed substantially circumferentially about the base portion 34. The outer member 18 conventionally is in the form of a decorative character. The outer member 18 includes a hole 40 generally axially aligned with the inner spout portion 32 of the inner member 11.

The insert 22 is formed of polyethylene, and has an insert base portion 42 and a radially outward flange 44 disposed substantially circumferentially about the base portion 42. The insert 22 further includes an insert hole 43. The outward flange 44 includes a taper portion 48 tapering radially inward away from the base portion at a radius of curvature "r" of approximately 0.975", such that insertion of the insert 22 into the outer member 18 causes the taper portion 48 of the insert 22 to progressively outwardly expand the inward flange 38 of the outer member 18 until the outward flange 44 passes the inward flange 38 to provide cooperative engagement with the inward flange 38. Once engaged, axial movement of the outer member 18 causes axial movement of the insert 22 to move between an open and closed position. As is well known, when in the open position, product flows from the container 12, through the inner member radial openings 33, through the insert hole 43, and finally through the outer member hole 40. When in the closed position, the inner spout portion 32 of the inner member 14 extends though the hole 43 of the insert 22, such that the insert blocks the radial openings 33 of the inner member 14, blocking flow of the product.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

We claim:

1. A closure for selectively controlling flow of product from a container, the closure comprising an outer member having a base portion and a top portion, an insert and an inner member, wherein the inner member is adapted for attachment to the container, the inner member cooperating with the insert to control the flow of product, the outer member and the insert including cooperative attachment means such that axial movement of the outer member causes axial movement of the insert to control the flow of product, an improved attachment means comprising:

a radially inward flange disposed substantially circumferentially about the base of the outer member;

a radially outward flange disposed substantially circumferentially about the base of the insert, the outward flange for cooperative engagement with the inward flange, wherein the outward flange includes a taper portion, the taper portion being outwardly concave relative to where the outward flange moets the insert, to assist insertion of the insert into the outer member such that the outward flange passes the inward flange.

2. The closure of claim 1 wherein insertion of the insert into the outer member causes the taper portion of the insert to progressively outwardly expand the inward flange of the outer member until the outward flanqe passes the inward flange to provide cooperative engagement with the inward flange.

3. The closure of claim 2 wherein insertion of the insert into the outer member and enqagement of the outward flange with the inward flanqe allows axial movement of the outer member to cooperate with axial movement of the insert to control the flow of the product.

4. A method of assembling a closure, the closure for selectively controlling flow of product from a container, the method comprising the steps of:

providing an inner member, wherein the inner member is adapted for attachment to the container;

providing an outer member having a base portion, a top portion and means defining a radially inward flange disposed substantially circumferentially about the base of the outer member;

providing an insert having a base portion and a radially outward flange disposed substantially circumferentially about the base portion, wherein the outward flange includes a taper portion being outwardly concave relative to where the outward flange meets the insert; and inserting the insert into the outer member such that the taper portion of the insert progressively outwardly expands the inward flange of the outer member until the outward flange passes the inward flange to provide cooperative engagement with the inward flange such that axial movement of the outer member causes axial movement of the insert to control the flow of product.

5. A closure for selectively controlling flow of product from a container, the closure comprising:

an inner member adapted for attachment to the container;

an outer member having a base portion, a top portion and means defining a radially inward flange disposed substantially circumferentially about the base of the outer member;

an insert having a base portion and a radially outward flange disposed substantially circumferentially about the base portion, wherein the outward flange includes a taper portion tapering radially inward away from the base portion, the taper portion baing outwardly concave relative to where the outward flange meets the insert such that insertion of the insert into the outer member causes the taper portion of the insert to progressively outwardly expand the inward flange of the outer member until the outward flange passes the inward flange to provide cooperative engagement with the inward flange such that axial movement of the outer member causes axial movement of the insert to control the flow of the product.

* * * * *

UNITED STATES PATENT AND TRADEMARK OFFICE

CERTIFICATE OF CORRECTION

PATENT NO. : 5,489,050

DATED : February 6, 1996

INVENTOR(S) : Daniel J. Finkiewicz, Gerald R. Sorensen, John E. Sowinski

It is certified that error appears in the above-indentified patent and that said Letters Patent is hereby corrected as shown below:

In Col. 2, line 62, delete "moets" and insert --meets--.

In Col. 3, line 1, delete "flanqe" and insert --flange--.

In Col. 3, line 5, delete "enqagement" and insert --engagement--.

In Col. 3, line 6, delete "flanqe" and insert --flange--.

Signed and Sealed this

Third Day of September, 1996

*Attest:*

Bruce Lehman

BRUCE LEHMAN

*Attesting Officer*

*Commissioner of Patents and Trademarks*